US008468844B2

(12) United States Patent
Nagel et al.

(10) Patent No.: US 8,468,844 B2
(45) Date of Patent: Jun. 25, 2013

(54) REMOVABLE AIR-BAFFLE STRUCTURE FOR REFRIGERATED DISPLAY CASES WITH OPEN SHELVING

(75) Inventors: Thomas O. Nagel, Blairstown, NJ (US); Joseph F. Kologe, Scranton, PA (US)

(73) Assignee: Trion Industries, Inc., Wilkes-Barre, PA (US)

( * ) Notice: Subject to any disclaimer, the term of this patent is extended or adjusted under 35 U.S.C. 154(b) by 868 days.

(21) Appl. No.: 12/633,132

(22) Filed: Dec. 8, 2009

(65) Prior Publication Data

US 2010/0199696 A1 Aug. 12, 2010

Related U.S. Application Data

(60) Provisional application No. 61/151,904, filed on Feb. 12, 2009.

(51) Int. Cl.
*A47F 3/04* (2006.01)

(52) U.S. Cl.
USPC ..... 62/255

(58) Field of Classification Search
USPC ..... 62/255
See application file for complete search history.

(56) References Cited

U.S. PATENT DOCUMENTS

| | | | | |
|---|---|---|---|---|
| 3,115,019 | A | 12/1963 | Rutishauser | |
| 3,369,375 | A | 2/1968 | Gerweck et al. | |
| 3,584,467 | A | 6/1971 | Barroero | |
| 3,827,254 | A | 8/1974 | MacMaster et al. | |
| 3,998,069 | A * | 12/1976 | Kronenberger et al. | 62/288 |
| 4,314,458 | A | 2/1982 | Hade et al. | |
| 5,402,897 | A | 4/1995 | Garfinkle | |
| 5,502,979 | A | 4/1996 | Renard | |
| 5,788,089 | A | 8/1998 | Garfinkle | |
| 6,012,594 | A * | 1/2000 | Heinz | 211/46 |
| 6,619,052 | B1 | 9/2003 | Nash, Jr. | |
| 6,955,061 | B2 | 10/2005 | Chiang et al. | |
| 6,959,560 | B2 | 11/2005 | Weikel et al. | |
| 7,438,268 | B2 | 10/2008 | Kologe | |
| 2001/0003248 | A1 | 6/2001 | Otto et al. | |
| 2006/0207279 | A1 | 9/2006 | Daddis, Jr. et al. | |
| 2008/0185353 | A1 * | 8/2008 | Immerman et al. | 211/16 |

* cited by examiner

*Primary Examiner* — Melvin Jones
(74) *Attorney, Agent, or Firm* — St. Onge Steward Johnston & Reens LLC

(57) ABSTRACT

An air baffle structure for refrigerated display cases having an open front and provided with openings at the back for the forwardly directed flow of refrigerated air. The display case has a display bar of non-circular cross section for mounting a plurality of display trays. A baffle support, formed of wire and having a front portion and spaced apart side portions, is mounted on the display bar and extends closely underneath the trays. A flat, plastic baffle plate is carried by the baffle support. The baffle support has rear portions of inverted U-shape engaging the display bar, formed in part by upwardly extending baffle positioning elements. Back edge portions of the baffle plate releasably engage the positioning elements to secure the baffle plate in position while accommodating easy removable and replacement for cleaning. A baffle plate typically will extend under a plurality of display trays positioned on the display bar.

14 Claims, 4 Drawing Sheets

REMOVABLE AIR-BAFFLE STRUCTURE FOR REFRIGERATED DISPLAY CASES WITH OPEN SHELVING

CROSS-REFERENCE TO RELATED APPLICATIONS

This application claims the benefit under 35 U.S.C. §119 (e) of U.S. Provisional Patent Application Ser. No. 61/151,904, filed Feb. 12, 2009, the entire content of which is incorporated herein by reference.

FIELD OF THE INVENTION

The invention relates to the display of perishable food products in open-front, refrigerated display cases in a manner to efficiently cool the food products while minimizing the loss of refrigerated air.

BACKGROUND OF THE INVENTION

Food products such as deli meats, salad greens, etc. are frequently displayed in open front refrigerated display cases that enable the customer to access and remove products without requiring doors to be opened and closed. A typical form of such a display case is illustrated in the Weikel et al. U.S. Pat. No. 6,959,560. That patent illustrates a vertically oriented cabinet having bottom top and back walls, and an open front. A plurality of levels of displayed products are mounted from the back wall, in the illustrated display case, by means of peg hooks. Refrigerated air is directed behind the back wall by means of a suitable fan, and outlets are provided in the back wall to allow the refrigerated air to flow out of the back wall and toward the displayed products.

If the refrigerated air issuing forwardly from the back wall of the display case is not properly guided, it will tend, because of its higher density, to flow downward before reaching some of the displayed product items located near the front of the display case. To deal with this problem, it is known to provide various forms of baffles to keep the refrigerated air from flowing downward before it reaches outer portions of the product display. In some cases, where the display case incorporates shelving on which the products are displayed, the shelves themselves serve as the necessary baffles. In other cases, such as in the above mentioned Weikel et al. '560 patent, where peg hooks or the like are used to display the product, separate means, such as baffles need to be provided.

Other arrangements for providing baffles are shown in, for example, the Garfinkle U.S. Pat. Nos. 5,402,897 and 5,788,089.

Known arrangements for providing air-directing baffles in refrigerated display cases have various shortcomings, which makes their use difficult or inconvenient. Frequently, arrangements such as twisted wires are utilized to hold the baffles in position, which tends to make their installation cumbersome and inconvenient. More importantly, it makes periodic removal of the baffles for cleaning very inconvenient, such that the important chore of maintaining clean baffles, in order to have clean, attractive and sanitary displays, is likely to be done on a relatively infrequent basis.

SUMMARY OF THE INVENTION

The invention is directed to a novel and improved form of air baffle structure for open front refrigerated display cases. The new baffle structure is adapted to be mounted on a horizontally disposed product display bar, typically of square or rectangular cross section, mounted at the back of the display case. The display bars each mount a plurality of product display trays which extend forwardly from the display bars and are arranged to receive products for display. In a preferred but non-limiting form of the invention, the product display trays are in the form of wire-bottom trays provided with pusher means for maintaining the product at the front of the display. The new baffle structure comprises in part a baffle support, preferably formed of wire, which is mounted on the same display bar as the product display tray with which it is associated and extends forwardly, typically underneath the display tray.

The baffle support, which can be of generally horizontally disposed U-shaped configuration, is provided at its inner ends with vertically extending portions fixed to mounting clips of generally inverted U-shaped configuration for mounting of the baffle support on the display bar. A baffle plate, which can be of flat, plastic construction, is carried by the baffle support. To particular advantage, the back edge portion of the baffle plate has positioning elements which cooperate with the vertically extending portions of the baffle support to engage and position the baffle on its support. The baffle plate is of sufficient width to extend under several product display trays. For a typical display case, having an internal width of four feet, the baffle structures may advantageously be provided in units of two-foot width, such that a pair of baffle structures mounted side-by-side can provide effective baffling for the entire width of the display.

For a more complete understanding of the above and other features and advantages of the invention, reference should be made to the following detailed description of a preferred embodiment, and to the accompanying drawings.

DETAILED DESCRIPTION OF THE INVENTION

Figure 1:
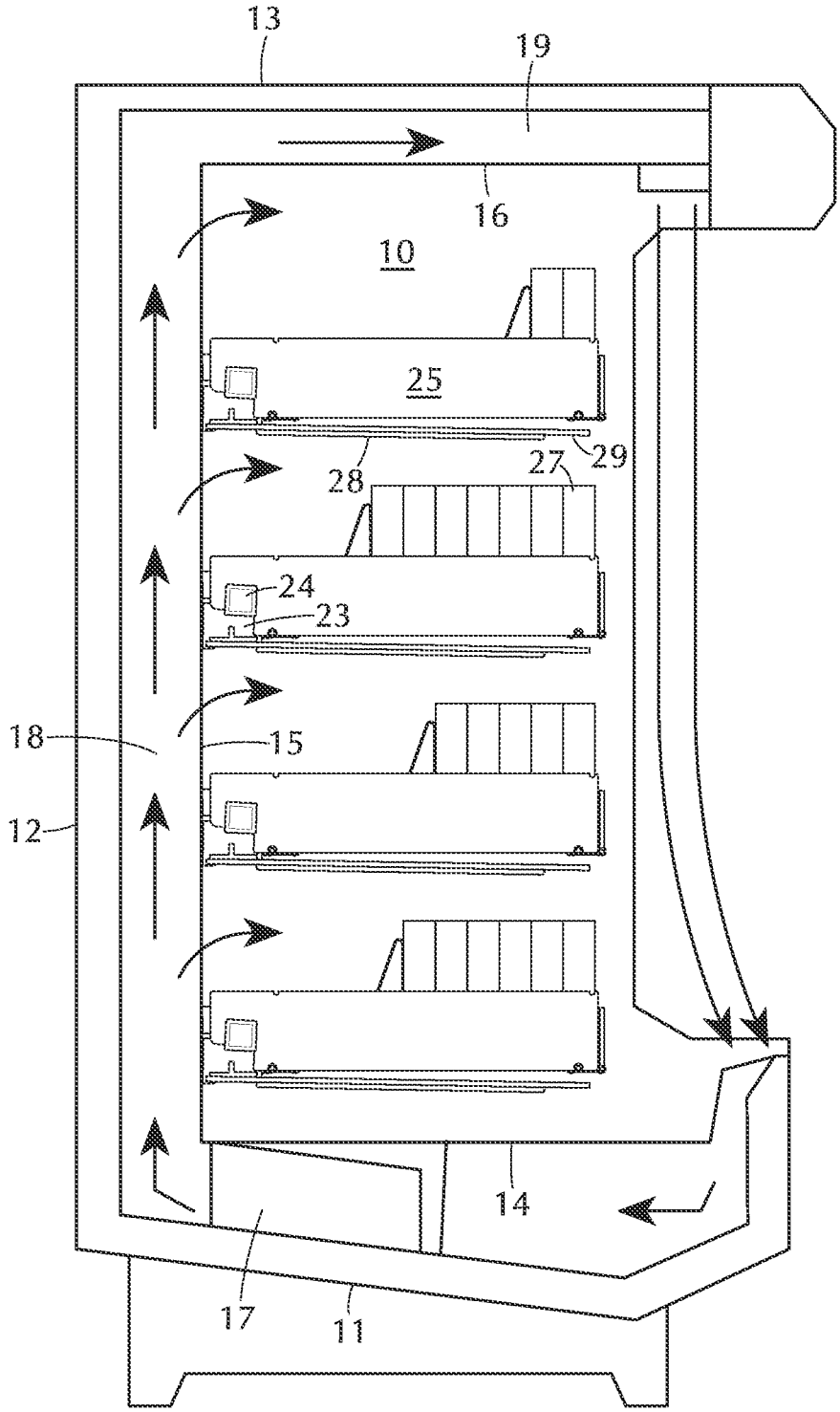
FIG. 1 is a simplified representational illustration of a refrigerated display case incorporating air baffle structures according to the invention.

Referring now the drawings, and initially to FIG. 1 thereof, the reference numeral 10 designates generally a representative form of open front refrigerated display case, such as frequently used in supermarkets and the like for the display and sale of deli products, salad makings, and other perishable products. A typical such case has outer bottom, back and top walls 11-13, and also inner bottom, back and top walls 14-16. The inner walls are spaced from the outer walls to provide an air passage. A fan and cooler system 17 is provided in the bottom of the display case and provides for the circulation of refrigerated air upwardly along a back channel 18 and top channel 19. The inner back wall 15 is provided with openings 20 (FIG. 2) such that refrigerated air flowing up the back channel 18 is caused to flow through the inner back wall and forwardly in the product display area of the display case.

Figure 5:
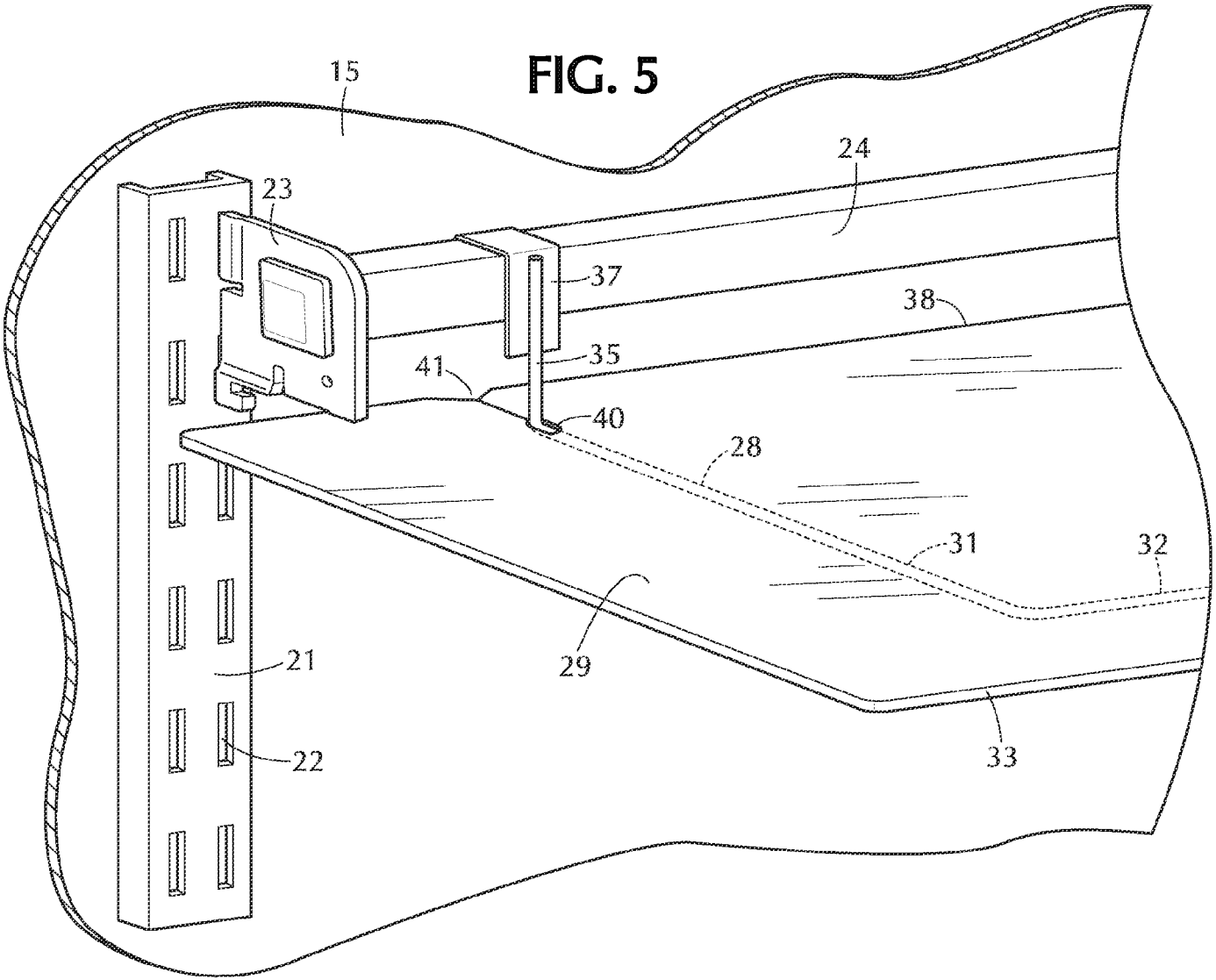
FIG. 5 is a perspective view illustrating a display bar on which a baffle and baffle support according to the invention is mounted.

In the illustrated structure, the back wall 15 mounts spaced pairs of vertical rails 21 (FIG. 5) provided with vertically spaced slots 22 for the reception of mounting brackets 23 for positioning product display bars 24. The product display bars and their mountings are previously known and are illustrated and described in U.S. Pat. No. 7,438,268 of Trion Industries, Inc., the content of which is incorporated herein by reference. The display bars are adjustably positioned in the display case at various vertical locations, as reflected generally in FIG. 1. Typically, the display bars will extend laterally across a predetermined width segment of the display case (for example, two feet) to accommodate the side-by-side positioning of a plurality of product display trays 25. In the illustrated structure, the display bars are indicated to be of square cross section, but also can be rectangular or other non-circular shape that will prevent rotation of objects supported thereon.

Figures 2, 6:
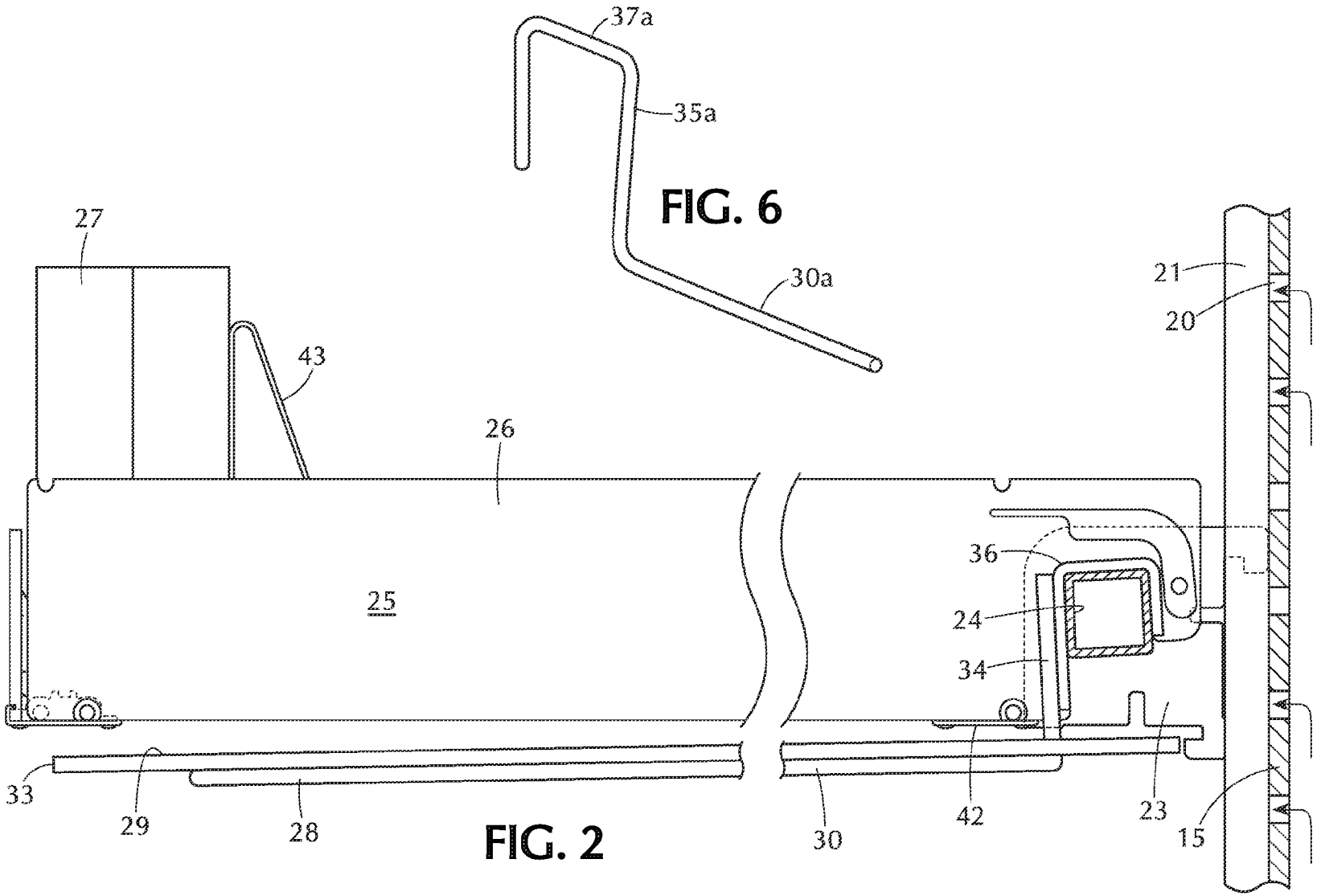
FIG. 2 is an enlarged side view showing features of an advantageous form of product display tray utilized in connection with the air baffle structure of the invention in the display case of FIG. 1.
FIG. 6 is a partial perspective view of an alternative and preferred form of baffle support for use in connection with the invention.

The illustrated form of display tray, shown in more detail in FIG. 2, is intended to be representative only and in no way limiting, but is nevertheless an advantageous form of display tray for use in conjunction with the air baffle structure of the invention. The illustrated form of display tray forms the subject matter of the Thomas O. Nagel U.S. patent application Ser. No. 12/354,398, filed Jan. 15, 2009, the content of which is incorporated herein by reference. The display tray 25 comprises a pair of spaced-apart side plates 26, which are mounted at opposite sides of an open wire bottom structure (not shown) for adjustable width positioning appropriate to the width of products 27 to be displayed. A spring-operated pusher 43 is mounted on the wire bottom structure and serves to urge the products 27 to forwardmost positions in the display tray. The back portions of the side plates 26 are formed with downwardly opening notches of a size and shape to be closely received over a display bar 24, such that the entire display tray 25 is supported in cantilever fashion by the bar 24. Typically, a single twenty-four inch display bar 24 will mount a plurality of the trays 25. For example, for displayed products of five-inch width, four of the display trays 25 may be placed in side-by-side relation on a single bar 24.

In accordance with the invention, a novel form of air baffle structure is provided, which is easily mounted on the display bars 24 and closely associated with the display trays 25 (in whatever form) to guide the flow of refrigerated air forwardly in the display case 10, so that proper cooling of the outermost product packages is assured. The illustrated form of baffle structure comprises a baffle support 28 arranged to underlie and support a baffle plate 29. The baffle support 28 advantageously is formed primarily of wire of a suitable size (e.g., 0.212-0.187 inch) formed generally in the shape of a rearwardly opening horizontal "U".

In the illustrated embodiment of the invention, the baffle plate 29 is formed of a suitable plastic, for example, a PVC sheet material of about 0.050 thickness. The baffle plate preferably is of clear plastic, but may also be of black or other opaque or translucent material. Advantageously, the baffle plate has a substantial width, for example, twenty-four inches to correspond with the space between vertical rails 21. The baffle width is not a critical feature, but optimally will be of a width that is easy for store personnel to handle yet wide enough to minimize the number of baffle plates that are required to be handled during installation and cleaning. In the illustrated arrangement, the baffle plate 29 has a length such as to approach, but preferably not extend beyond the front of the display trays 25. Ideally, the baffle plate 29 is positioned close to the bottoms of the trays 25 and slightly recessed from the outer ends thereof so as to be substantially inconspicuous to the customer.

In the illustrated and preferred form of the invention, the U-shaped wire support 28 is comprised of a pair of outwardly extending side elements 30, 31 which are spaced apart a distance less than the width of the baffle plate 29. The side elements 30, 31 are joined at their outer ends by an outer element 32 that is positioned somewhat inward from the outer edge 33 of the baffle plate. The innermost ends of the side elements 30, 31 are bent upwardly, as indicated at 34, 35 in FIGS. 2 and 5. In the illustrated structure, these upwardly bent sections 34, 35 are welded or otherwise fixed to downwardly opening, generally inverted U-shaped mounting clips 36, 37. The mounting clips 36, 37 are dimensioned to fit snugly over the product display bar 24 such that the U-shaped support 28 is held in a substantially horizontal orientation. It will be understood, of course, that the mounting clips 36, 37 need not be separate elements but preferentially may be shaped from integral and continuous portions of the wire forming the support 28. The geometry of the mounting clip portions 36, 37 and the upwardly extending wire portions 34, 35 is such that the horizontal portions of the baffle support closely underlie the bottoms of the trays 25, substantially as shown in FIG. 2. See FIG. 6, where the mounting clip portion 37*a* for the side element 30*a* is formed by an inverted U-shaped end section forming an integral extension of the upwardly bent section 35*a* of the side element.

In one preferred embodiment of the invention, the width of the U-shaped baffle support 28 is about sixteen inches, for supporting a twenty-four inch baffle plate, leaving an overhang margin of about four inches at each side. A similar overhang may be provided at the front. In this respect, however, since the trays 25 may be provided in a variety of lengths, the baffle plates 29 also are advantageously provided in corresponding lengths, such that the outer edges 33 of the baffle plates are, insofar as practicable, positioned relatively close to but behind the front edges of the trays 25, so as to be somewhat concealed.

In accordance with one aspect of the invention, the baffle plates 29 are provided at their back edges with forwardly extending slits (or narrow slots) 39 which extend forwardly for about two inches and join with elongated openings 40. The openings 40 are of a width approximately that of the upwardly extending wire elements 34, 35. To best advantage, the openings 40 may have a width just slightly less than that of the wire portions 34, 35, so as to lightly grip the wire portions.

Figure 4:
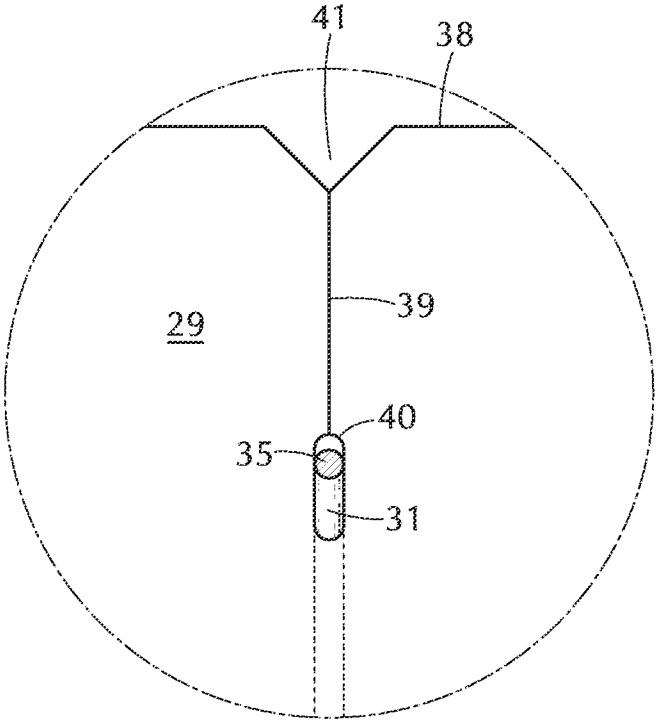
FIG. 4 is an enlarged, fragmentary view of a back portion of the baffle, illustrating the manner in which the baffle is engaged with the baffle support for positioning and retention.
Figure 3:
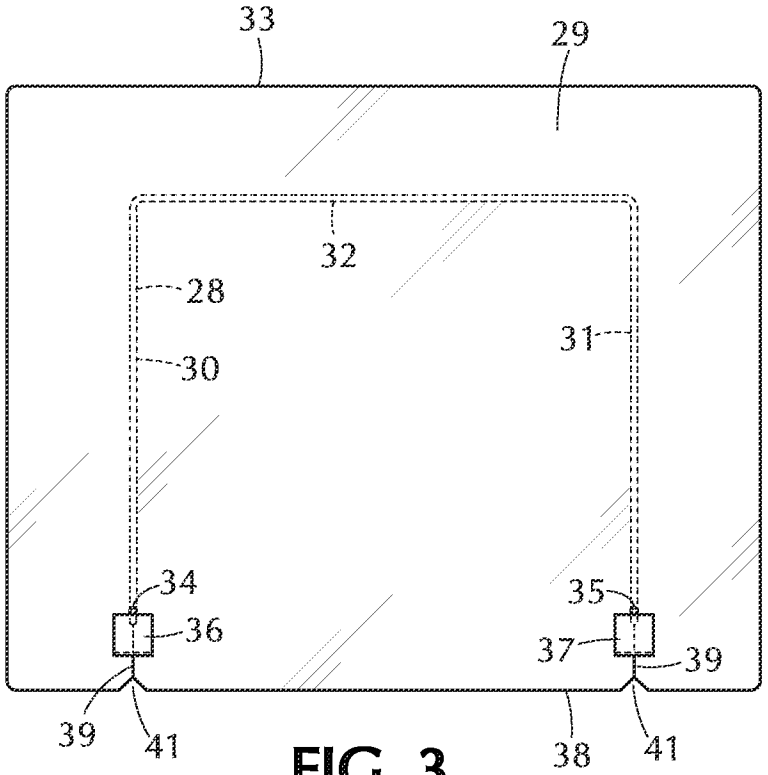
FIG. 3 is a top plan view of a baffle and baffle support according to the invention.

After installation of the baffle support 28 on the display bar 24, the baffle plate 29 is installed by laying it on top of the support 28 and pressing it rearwardly. At the rearmost ends of the slits 39, the back edge 38 of the baffle plate is provided with V-shaped entry notches that facilitate locating the baffle plate relative to the vertically extending wire portions 34, 35. Once the wire portions are seated in the V-shaped notches 41, the installer presses rearwardly against the baffle plate to force the wire portions 34, 35 into the slits 39 and, eventually, into the wider openings 40, substantially as shown in FIG. 4. When the wire portions 34, 35 reach the openings 40, the slits 39 reclose, so the baffle plates are firmly locked into position against accidental dislodgement.

In the arrangement shown in FIG. 2 for mounting of the respective baffle support 28 and display trays 25, there is minimal limitation on the positioning of the trays on the display bar 24 after mounting of the baffle support thereon. In this respect, the mounting clips 36, 37 are in generally fixed locations on the display bar 24, occupying a narrow width of, for example, a little over an inch for each mounting clip. The side plates 26 of the trays, by which the trays are mounted on the display bars, are relatively narrow, for example, around 1/16th inch in thickness. Additionally, the location of the bar-receiving notches at the back of the side plates 26 is such as to allow the upwardly extending portions 34, 35 of the baffle supports to be positioned rearwardly of the bottom structure of the tray (not fully shown but reflected in the positioning of the rear base element 42 of the tray), such that the upwardly extending wire portions 34, 35 can be positioned almost anywhere within or alongside the confines of a particular tray.

One of the important advantages of the baffle structure of the invention is that the baffle plates may be easily removed from and replaced in the displays. The baffles can be removed by simply gripping the projecting outer edge portions of the baffle plates and pulling outwardly, causing the wire upright portions 34, 35 to slide rearward through the slits 39 to fully release the plates. This can be done easily with the product display trays 25 in place. Likewise, to reinstall the baffle plates, they are simply slid rearwardly along the upper surfaces of the supports 28 until the notches 41 align with the wire elements 34, 35, after which additional rearward pressure is applied to the baffle plate to seat the wires in the openings 40. The thus-facilitated removal and replacement procedure enables the baffles to be frequently cleaned and sanitized so that food product displays can be easily maintained in a pristine condition, attractive to prospective purchasers. In this respect, it will be understood that the baffle plates tend to collect miscellaneous debris, which becomes unsightly after a time. Additionally, the chilled atmosphere of the open front displays can foster the development of mold, which becomes extremely unsightly and unsanitary if not adequately cleaned. With known types of baffles, the removal and replacement is sufficiently inconvenient that store personnel tend to ignore or postpone the desired cleaning routines, leading to unattractive and unsanitary displays of the food products.

In the specifically illustrated form of the invention, where the product display trays 25 are provided with open bottom structures formed of a few wire elements, there are minimal surfaces for the development of mold growth. This, combined with the ease of cleaning of the baffles 29 as described, provides optimal conditions for the open front display of refrigerated food products.

It will be understood that the preferred embodiment of the invention herein illustrated and described is intended to be representative only, as various changes may be made therein without departing from the clear teachings of the disclosure. Accordingly, reference should be made to the following appended claims in determining the full scope of the invention.

What is claimed is:

1. An air baffle structure for an open front refrigerated display case, where the display case is provided with a back wall with openings for the forward flow of refrigerated air and where a display bar of non-circular cross section extends horizontally in front of said back wall, which comprises, (a) one of more product display trays mounted in cantilever fashion at back ends thereof on said display bar and extending forwardly from said display bar for the display of merchandise in said display case, (b) a baffle support mounted on said display bar and extending generally horizontally forwardly therefrom, (c) said baffle support including laterally spaced apart support elements extending horizontally outward with respect to said display bar and upwardly extending portions joined with inner end portions of said support elements, (d) said upwardly extending portions being secured to and positioned adjacent to said display bar, and (e) a thin, generally flat baffle plate removably supported on said baffle support, (f) said baffle support and said baffle plate extending underneath said one or more trays in closely spaced relation to bottoms thereof, (g) said baffle plate having positioning elements at a rear edge region thereof engaging said upwardly extending portions for releasably positioning said baffle plate with respect to said baffle support.

2. The air baffle structure of claim 1, wherein (a) said positioning elements are spaced apart slots in said rear edge region of the baffle plate for the reception of said upwardly extending portions.

3. The air baffle structure of claim 2, wherein (a) said spaced apart slots are narrower in width than a width of said upwardly extending portions, and (b) said positioning elements include enlarged portions at forward ends of said slots, and (c) said enlarged portions receive said upwardly extending portions when said baffle plate is properly positioned on said baffle support.

4. The air baffle structure of claim 1, wherein (a) rear edge regions of said baffle plate extend behind said upwardly extending portions of said baffle support, toward said back wall.

5. The air baffle structure of claim 1, wherein (a) said baffle support includes a pair of mounting portions of generally inverted U-shaped configuration for reception over said display bar, (b) said mounting portions each comprise front and back generally vertically extending portions connected at upper ends thereof by a generally horizontally extending portion, and (c) one of said generally vertically extending portions extends from one of the upwardly extending portions at each side of said baffle support.

6. The air baffle structure of claim 5, wherein (a) the spaced apart support elements of said baffle support, and said upwardly extending portions thereof, are formed of a continuous section of wire.

7. The air baffle structure of claim 1, wherein (a) said baffle plate has a width dimension such, in relation to a width dimension of said display trays, as to be able to underlie a plurality of display trays.

8. The air baffle structure of claim 1, wherein (a) the baffle support includes a cross member connecting the respective support elements in spaced apart relation.

9. The air baffle structure of claim 8, wherein (a) the cross member is integrally joined with outer ends of the respective support elements.

10. An air baffle structure for an open front refrigerated display case, where the display case is provided with a back wall with openings for the forward flow of refrigerated air and where means are provided for supporting in said display case a plurality of product display trays arranged in vertically spaced horizontal rows with each row comprising a plurality of product display trays, said baffle structure comprising (a) a plurality of vertically spaced display bars extending laterally across at least a portion of the width of said refrigerated display case, (b) said plurality of product display trays being mounted in cantilever fashion and in side-by-side relation on said display bars, (c) baffle supports mounted at inner ends thereof in cantilever fashion on said display bars and extending outwardly relative to said back wall closely underneath one or more of said product display trays mounted on the same display bar, (d) said baffle supports each including a laterally spaced apart pair of baffle support elements extending outwardly with respect to said back wall, (e) a thin, generally flat baffle plate removably supported on each pair of said spaced apart baffle support elements closely adjacent to but spaced below bottoms of said display trays, (f) at least one of said baffle support elements of each pair having an associated upwardly projecting baffle plate positioning element releasably engageable with a positioning element on said baffle plate for releasably securing said baffle plate in a predetermined working position on said baffle support.

11. The air baffle structure of claim 10, wherein (a) said baffle support elements each have an upwardly projecting baffle plate positioning element adjacent to a back end thereof, and (b) said baffle plates each have a pair of laterally spaced apart rearwardly opening slots therein releasably engageable with said upwardly projecting baffle plate positioning elements for positioning said baffle plate.

12. The air baffle structure of claim 10, wherein (a) said baffle plates are of sufficient width to extend underneath at least two of said product display trays.

13. The air baffle structure of claim 10, wherein (a) each of said baffle support elements has an associated baffle plate positioning element and each of said baffle plates has a pair of positioning elements for releasable engagement with said baffle plate positioning elements, (b) said positioning elements on said baffle plates comprise rearwardly opening slots of a width narrower than a width of said baffle plate positioning elements, and (c) openings of greater width than said slots are connected to forward ends of said slots for receiving said baffle plate positioning elements.

14. The air baffle structure of claim 10, wherein (a) said baffle plate is of generally rectangular configuration having spaced apart lateral edges and a front edge, (b) said baffle support is of a rearwardly opening, generally U-shaped configuration including laterally spaced apart elements extending outwardly and a laterally extending element connecting outer end portions of said laterally spaced apart elements, and (c) said laterally spaced apart elements and said laterally extending element of said baffle support being spaced inward from said lateral and front edges of said baffle plate.

* * * * *